United States Patent [19]

Stern et al.

[11] Patent Number: 4,565,982

[45] Date of Patent: Jan. 21, 1986

[54] MILLIMETER-WAVE ELECTRONIC PHASE SHIFTER USING SCHOTTKY BARRIER CONTROL

[75] Inventors: Richard A. Stern, Allenwood; Elio A. Mariani, Hamilton Square, both of N.J.

[73] Assignee: The United States of America as represented by the Secretary of the Army, Washington, D.C.

[21] Appl. No.: 505,668

[22] Filed: Jun. 20, 1983

[51] Int. Cl.[4] ..... H01P 1/18

[52] U.S. Cl. ..... 333/157; 333/164; 357/15

[58] Field of Search ..... 333/164, 157, 156, 161, 333/248, 250, 258, 262; 343/770, 767, 768, 777, 778, 754, 701; 357/15, 22

[56] References Cited

U.S. PATENT DOCUMENTS 3,944,950 3/1976 Jacobs et al. ..... 333/164
4,382,261 5/1983 Freibergs ..... 343/701 X

OTHER PUBLICATIONS

Fleming, P. L. et al.; "GaAs SAMP device for Ku-band switching", Cart, 1979, *IEEE MITS, Int'l Microwave Symposium Digest,* Orlando, Fla., Apr. 30–May 2, 1979.

*Primary Examiner*—Eugene R. Laroche
*Assistant Examiner*—Benny T. Lee
*Attorney, Agent, or Firm*—Anthony T. Lane; Jeremiah G. Murray; Paul A. Fattibene

[57] ABSTRACT

A millimeter-wave electronic phase shifter in a dielectric waveguide having a semi-insulating dielectric core and at least one semi-conducting epitaxial layer. A controller affixed to the epitaxial layer is used to apply a bias voltage thereby varying the conductivity of the epitaxial layer and influencing wave propagation in the waveguide.

10 Claims, 6 Drawing Figures

MILLIMETER-WAVE ELECTRONIC PHASE SHIFTER USING SCHOTTKY BARRIER CONTROL

STATEMENT OF GOVERNMENT INTEREST

The invention described herein may be manufactured, used and licensed by or for the Government for Governmental purposes without the payment to us of any royalties thereon or therefor.

CROSS REFERENCE TO RELATED APPLICATIONS

This invention is related to the following co-pending applications filed in the names of R. A. Stern and E. A. Mariani, the present inventors:

U.S. Ser. No. 505,667, entitled, "Monolithic Millimeter-Wave Electronic Scan Antenna Using Schottky Barrier Control and Method For Making Same", filed on June 20, 1983; and U.S. Ser. No. 505,666, entitled "Millimeter-Wave Cut-Off Switch", filed on June 20, 1983.

BACKGROUND OF THE INVENTION

This invention relates generally to the field of millimeter-wave control devices, and more particularly, to a monolithic, millimeter-wave phase shifter.

Rectangular dielectric waveguide is used as the transmission medium in millimeter wave systems because it offers a low-loss characteristic and lends itself to low-cost fabrication. The lack of suitable control devices, such as phase shifters, for use in dielectric waveguide systems has, however, been as obstacle in creating fully integrated, monolithic designs. While there is relatively little previous art in the field of millimeter wave phase shifters, the designs which have been proposed use discrete elements such as diodes or ferrite toroids in various waveguide configurations. An example of this design format is found in U.S. Pat. No. 3,959,794 which implements conductivity modulation to alter the boundary conditions of a waveguide by using the distributive characteristics of a PIN diode appended to the guide.

The typical problems associated with many of these earlier devices arise from the use of the discrete elements which causes wave distortion and increases both the cost and complexity of the device.

SUMMARY OF THE INVENTION

The object of this invention is to provide a monolithic electronic phase shifter for use in a dielectric waveguide configuration.

A further object of the invention is to provide a phase shifter of minimum complexity in order to permit low-cost, batch fabrication.

The millimeter-wave phase shifter according to the invention uses waveguide of semi-insulating GaAs having a semi-conducting GaAs epitaxial layer and a distributed Schottky barrier control element deposited on the epitaxial layer. The application of a reverse bias voltage to the Schottky barrier control element causes a change in the device insertion phase, or a phase shift in a wave traveling through the waveguide.

This and other objects and advantages of the invention will become apparent from the following detailed description and drawings.

DETAILED DESCRIPTION OF THE PREFERRED EMBODIMENT

Figure 1:
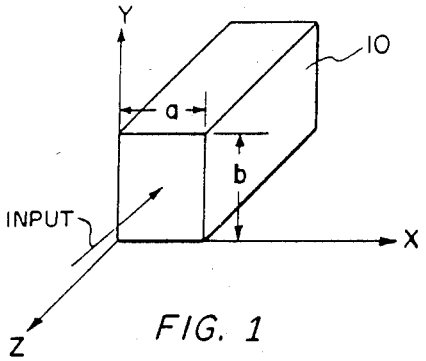
FIG. 1 is a schematic of a conventional dielectric waveguide adapted to propagate millimeter-wave energy.
Figure 2:
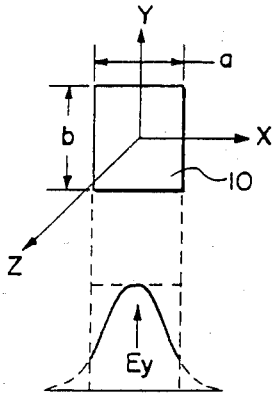
FIG. 2 illustrates an end view of the waveguide medium of FIG. 1 and the field configuration for wave propagation.

In the millimeter frequency range, dielectric waveguide transmission lines provide an inexpensive means for low-loss electromagnetic wave propagation. As shown in FIG. 1, a conventional section of dielectric waveguide 10 having a cross-section width a and height b will propagate low-loss, fundamental-mode wave energy along the Z-axis. The waveguide 10 consists of a low-loss dielectric material with a relative dielectric constant, $\epsilon_r$, in the range of 2 to 16. As shown in FIG. 2, the electric field, $E_y$, is confined to the waveguide 10 except for an exponentially decaying evanescent field external to the guide. Confined propagation in the dielectric waveguide occurs because of total internal reflection and this confinement may be improved by either decreasing the wavelength, increasing the guide dimensions, or increasing the dielectric constant of the guide. Propagation may also be influenced by altering the boundary conditions at the surface of the guide.

Figure 3:
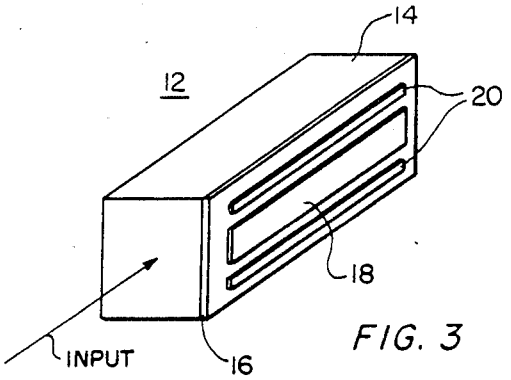
FIG. 3 is a pictorial representation of a millimeter-wave phase shifter according to a preferred embodiment the invention.

Referring now to FIG. 3 showing a section of dielectric transmission line, a phase shifter 12 comprises a semi-insulating dielectric core 14 and a semi-conducting epitaxial layer 16, both preferably of gallium arsenide. The terms semi-insulating and semi-conducting are used herein in the relative sense such that the semi-conducting material has a greater number of available conducting electrons in comparison to the semi-insulating material. The thickness of the epitaxial layer 16 is determined by the design operating frequency and will generally range from about two to ten microns. A Schottky barrier electrode 18, which is typically a metallization layer on the order of 1000 Å, and ohmic contacts 20 are provided on the outer surface of epitaxial layer 16 as a means for varying the conductivity of the epitaxial layer 16 to thereby alter the propagation characteristic of the waveguide. While the preferred embodiment of the invention uses a dielectric medium of GaAs having a relative dielectric constant, $\epsilon_r$, of approximately 13, alternate embodiments of the device could use other semiconductor materials such as silicon on sapphire. The dielectric waveguide is sapphire and the epitaxial layer is silicon. Gallium arsenide (GaAs) is given as the preferred medium because its higher mobility permits faster switching speeds as compared to silicon.

The operation of the phase shifter is based on a change in the boundary conditions of the waveguide as brought about by a change in the depletion depth of the epitaxial layer. This in turn changes the propagation constant of the guide and thereby accounts for a phase shift. In the present invention as shown in FIG. 3, the depletion depth in the semi-conducting layer beneath Schottky barrier plate 18 is varied with the application of a reverse DC bias voltage to ohmic contacts 20 such that the depth increases with increasing reverse bias until the entire epitaxial layer 16 is depleted of conducting electrons resulting in a non-conductive layer.

Figure 4:
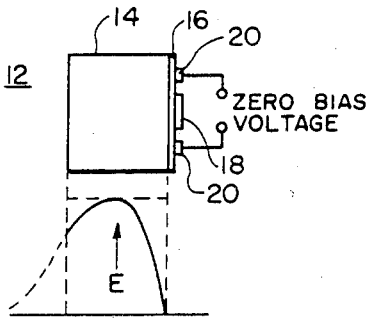
FIG. 4 illustrates and end view of the device of FIG. 3 showing the E-field configuration for wave propagation with zero bias voltage applied.
Figure 5:
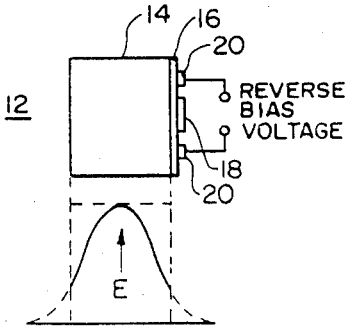
FIG. 5 illustrates an end view of the device of FIG. 3 showing the E-field configuration for wave propagation with a reverse bias voltage applied.

Referring to FIG. 4, an end view of the device of FIG. 3 is shown along with the electric field distribution for the zero bias voltage case. The shift in the E-field and resulting shift in phase occurs as a result of the boundary condition imposed by the semi-conducting epitaxial layer 16 which is in a conductive state at zero bias. In FIG. 5, showing the same view as FIG. 4 but with a reverse bias voltage of −10 to −20 volts applied to ohmic contacts 20, the epitaxial layer becomes non-conductive and produces a corresponding change in the E-field distribution and propagation characteristics of the waveguide. Thus, changing the epitaxial layer from conductive to non-conductive changes the guide wavelength thereby causing an electronically-controlled phase shift.

At millimeter wave frequencies, the Schottky barrier metallization thickness, typically about 1000 Å or 0.1 microns, is less than one skin depth. For example, at 35 GHz the skin depth for copper is 0.4 microns. Since two to three skin depths are ordinarily required to achieve a good conductor, the Schottky barrier metallization is only about one-tenth the thickness required for a good conductor at 35 GHz and thus, should not seriously affect the E-field distribution. This condition should also be valid for 94 GHz operation as well.

Figure 6:
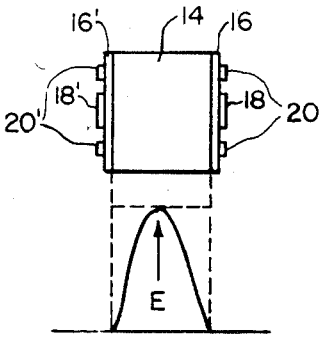
FIG. 6 is an end view of an alternate embodiment of the invention.

An alternate embodiment of the present device would use two semi-conducting epitaxial layers placed on opposite sides of a semi-insulating dielectric core 14 as shown in FIG. 6. The two epitaxial layers 16 and 16' are affixed to opposite sides of semi-insulating core 14, each of the layers having a Schottky barrier electrode 18 and 18' attached thereto. In practice, this configuration could be implemented by using two of the elements 12 of FIG. 3 having the semi-insulating layers bonded back-to-back such that the epitaxial layers form two opposing side surfaces in the resulting device. The net result of this structure would be an enhanced phase shift per unit length as compared to the simpler case described in relation to FIG. 3. This is caused by the E-field being confined within the waveguide due to the changed boundry conditions at the opposing surfaces of the waveguide. This confinement effectively elminates the external E-field, changing the propagation constant of the waveguide and therefore the phase shift.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. A millimeter-wave phase shifter comprising:

a dielectric waveguide of rectangular cross-section and an energy wave with an associated E-field distribution propagating longitudinally to said cross-section in said waveguide;

a first semi-conducting epitaxial layer formed on a first side surface of said dielectric waveguide;

ohmic contact means for applying a first bias voltage to said first epitaxial layer; and first Schottky barrier electrode means, formed on said first epitaxial layer, for varying the conductance of said epitaxial layer when the first bias voltage is applied thereby causing a portion of the E-field distribution of the energy wave to be partially displaced from said waveguide resulting in a change in phase of the propagating energy wave.

2. A phase shifter as set forth in claim 1 wherein said Schottky barrier electrode means includes a metallization layer having a thickness of less than one skin depth for a selected millimeter-wave frequency of said energy wave propagating in said waveguide.

3. A phase shifter as set forth in claim 1 further comprising:

a second semi-conducting dielectric epitaxial layer formed on a second side surface of said waveguide opposite said first side surface;

ohmic contact means for applying a second bias voltage to said second epitaxial layer; and second Schottky barrier electrode means, formed on said second epitaxial layer, for varying the conductance of said second epitaxial layer when the second bias voltage is applied thereby causing the energy wave to be confined within said waveguide, which has the effect of further varying the E-field distribution of the energy wave with a resulting further change in phase.

4. A phase shifter as set forth in claim 3 wherein said ohmic contact means for applying first and second bias voltages comprises:

a first pair of ohmic contacts formed on said first epitaxial layer so that said first Schottky barrier electrode means is disposed therebetween; and a second pair of ohmic contacts formed on said second epitaxial layer so that said second Schottky barrier electrode means is disposed therebeween.

5. A phase shifter as set forth in claim 4 wherein said Schottky barrier electrode means includes a metallization layer having a thickness of less than one skin depth for a selected millimeter wave frequency of said energy wave propagating in said waveguide.

6. A phase shifter as set forth in claim 1 wherein said semi-insulating dielectric waveguide and said semi-conducting dielectric epitaxial layer are formed of gallium arsenide.

7. A phase shifter as set forth in claim 1 wherein said dielectric waveguide is formed of sapphire and said semi-conducting dielectric epitaxial layer is formed of silicon.

8. A method of fabricating a monolithic, millimeter-wave electronic phase shifter comprising the steps of:

forming a semi-conducting dielectric first epitaxial layer on a side surface of a semi-insulating dielectric waveguide substrate;

forming a pair of ohmic contacts on said first epitaxial layer; and forming Schottky barrier electrode means on said first epitaxial layer between said pair of ohmic contacts.

9. The method as set forth in claim 8 further comprising:

forming a second semi-conductor epitaxial layer on a surface of said semi-insulating dielectric substrate positioned such that said first and said second epitaxial layers are opposing outer surfaces;

forming a second pair of ohmic contacts on said second epitaxial layer; and forming second Schottky barrier electrode means on said second epitaxial layer between said second pair of ohmic contacts.

10. A method of fabricating a millimeter-wave electronic phase shifter comprising the steps of:

forming a first semi-conducting epitaxial layer on a surface of a first semi-insulating dielectric waveguide;

forming a second semi-conducting epitaxial layer on a surface of a second semi-insulating dielectric waveguide;

forming a pair of ohmic contacts on each of said first and second epitaxial layers;

forming a Schottky barrier electrode means on each of said first and second epitaxial layers between each said pair of ohmic contacts; and combining said first and second waveguides by bonding together the surfaces of said first and second waveguides which are opposite said first and second epitaxial layers, such that said first and second epitaxial layers form opposing outer surfaces.

* * * * *